US008567884B2

(12) United States Patent
Isele et al.

(10) Patent No.: US 8,567,884 B2
(45) Date of Patent: Oct. 29, 2013

(54) SYNCHRONIZATION DEVICE FOR SYNCHRONIZING TWO ACTUATING DRIVES FOR MOVING A MOVABLE FURNITURE PART

(75) Inventors: Olaf Isele, Lustenau (AT); Harald Sutterluetti, Fussach (AT)

(73) Assignee: Julius Blum GmbH, Höechst (AT)

( * ) Notice: Subject to any disclaimer, the term of this patent is extended or adjusted under 35 U.S.C. 154(b) by 0 days.

(21) Appl. No.: 13/429,571

(22) Filed: Mar. 26, 2012

(65) Prior Publication Data

US 2012/0181909 A1 Jul. 19, 2012

Related U.S. Application Data

(63) Continuation of application No. PCT/AT2010/000379, filed on Oct. 11, 2010.

(30) Foreign Application Priority Data

Oct. 23, 2009 (AT) ..... 1673/2009

(51) Int. Cl.
*A47B 96/00* (2006.01)

(52) U.S. Cl.
USPC ..... 312/323; 312/110

(58) Field of Classification Search
USPC ..... 312/322, 323, 319.5–319.8, 109, 110, 312/325, 326, 327, 331, 294; 403/325, 326, 403/327, 264; 24/457, 458; 49/254
See application file for complete search history.

(56) References Cited

U.S. PATENT DOCUMENTS

| | | | | |
|---|---|---|---|---|
| 4,206,853 | A * | 6/1980 | Iten et al. | 220/759 |
| 4,591,214 | A * | 5/1986 | Reuter et al. | 312/110 |
| 4,600,254 | A * | 7/1986 | Whalen | 312/323 |
| 4,615,570 | A * | 10/1986 | Goodman | 312/110 |
| 4,641,896 | A * | 2/1987 | Iimura et al. | 312/110 |
| 4,923,259 | A * | 5/1990 | Bartok | 312/223.2 |
| 4,938,107 | A * | 7/1990 | Nickipuck | 81/177.85 |
| 5,026,130 | A * | 6/1991 | Wright et al. | 312/323 |
| 7,648,213 | B2 * | 1/2010 | Kangas | 312/333 |
| 8,152,250 | B2 * | 4/2012 | Aguilar Ante et al. | 312/331 |
| 2008/0054771 | A1 | 3/2008 | Brunnmayr | |

FOREIGN PATENT DOCUMENTS

| | | |
|---|---|---|
| WO | 2006/113953 | 11/2006 |
| WO | WO 2009114885 A1 * | 9/2009 |

OTHER PUBLICATIONS

Machine translation of Baldreich et al., WO 2009/114885 A1.*

(Continued)

*Primary Examiner* — James O Hansen
(74) *Attorney, Agent, or Firm* — Wenderoth, Lind & Ponack, L.L.P.

(57) ABSTRACT

The invention relates to a synchronization device for moving a first actuating device in synchronization with at least one second actuating device. The first actuating device and the second actuating device are provided on a piece of furniture in the installed state in order to move a movable furniture part. The device includes a synchronization rod for transferring a synchronous motion of the at least two actuating devices, and at least one fastening device, by which the synchronization rod can be detachably connected to at least one of the two actuating devices. At least one detachable locking device is also provided, which prevents the synchronization rod from being connected to the at least one fastening device in the locked state of the locking device, wherein the locking device is in the locking state without prior actuation by a user.

13 Claims, 6 Drawing Sheets

(56) References Cited

OTHER PUBLICATIONS

International Search Report issued Jan. 20, 2011 in International (PCT) Application No. PCT/AT2010/000379.

Austrian Patent Office Search Report completed Aug. 13, 2010 in Austrian Patent Application No. A 1673/2009.

* cited by examiner

SYNCHRONIZATION DEVICE FOR SYNCHRONIZING TWO ACTUATING DRIVES FOR MOVING A MOVABLE FURNITURE PART

This application is a Continuation of U.S. application Serial No. PCT/AT2010/000379, filed Oct. 11, 2010, the entire disclosure of which is incorporated herein by reference.

BACKGROUND OF THE INVENTION

The present invention relates to a synchronization device for synchronous movement of a first actuating device with at least one second actuating device. The first and second actuating devices in the mounted condition are provided on an article of furniture for moving a movable furniture part, including a synchronization rod for transmitting a synchronous movement of the at least two actuating devices, and at least one fixing device by way of which the synchronization rod can be releasably connected to at least one of the two actuating devices.

The invention further concerns an article of furniture having at least one synchronization device of the kind to be described.

WO 2006/113953 A1 to the present applicant describes a synchronization device of the general kind set forth, wherein the movement of two actuating devices can be synchronized by a synchronization rod. In that way, it is possible to implement a synchronous movement of the two actuating devices for driving a movable furniture part, in particular an upwardly movable flap. The two actuating devices are pre-assembled in a first mounting step to opposite side walls of the furniture carcass. In a subsequent mounting step, the synchronization rod can be connected to a rotatable part of the respective actuating device by way of a fixing device. That connection between the synchronization rod and the rotatable part of the respective actuating device can be made by a latching connection or a screw connection. When using a screw connection, it has frequently been found in practice that, due to lack of attention, the screw was not tightened at all from the outset by the mounting personnel. The loose screw means that an unwanted play remains between the synchronization rod and the rotatable part of the actuating device, which in most cases also results in an unharmonic movement of the two actuating devices relative to each other.

SUMMARY OF THE INVENTION

It is therefore an object of the present invention to propose a synchronization device of the general kind set forth in the opening part of this specification, having an improved fixing device.

In an advantageous configuration according to the invention, that object is achieved by providing at least one releasable locking device which prevents the synchronization rod from being connected to the at least one fixing device in a locking condition of the locking device, wherein the locking device is in the locking condition without prior actuation by a user.

In other words, there is proposed a releasable locking device having a locking condition and a release condition. When the locking device is in the locking condition, mounting of the synchronization rod to the respective actuating device is just not possible at all. It is only after the locking device has been moved into the release condition, triggered by intentional displacement by a user, that the synchronization device can be properly mounted to the respective actuating device.

The locking device can have, for example, a handle element which is adapted for hand actuation and which is manually movable against the force of a spring device upon mounting of the synchronization rod by a user into a position in which the locking device is in the release condition and thus mounting of the synchronization rod is possible. If (in contrast) the handle element is not actuated by a user, then the locking device is in the locking position and fitment of the synchronization rod is not possible.

In that respect, the synchronization rod can be mounted to the rotatable or pivotable part of the actuating device by way of a fixing device which can be tightened.

Substantially play-free arresting of the synchronization rod relative to the actuating drive makes it possible to implement synchronous actuating movement of the two actuating devices relative to each other.

In a preferred embodiment, parts of the locking device can also form parts of the fixing device, by which the synchronization rod can be secured relative to at least one the two actuating devices. In other words, existing parts of the locking device are also used at the same time as parts of the fixing device, by which the synchronization rod can be arrested to at least one actuating device. It is, however, also possible to involve locking devices which are separated from the actual fixing device.

The locking device can be moved manually without the use of a tool into a release condition. Alternatively, it can have a receiving device for a tool, in particular a screwdriver, in which case the release condition can be brought about by suitable actuation of the tool.

The fixing device can have a handle element to be actuated by a person and at least one arresting element which can be released and arrested by the handle element so that, after positioning has been effected, the synchronization rod can be secured relative to at least one of the two actuating devices. In that respect, it may be desirable if the arresting element can be loaded by a spring device in the direction of the arresting position or is continuously loaded by a spring device in the direction of the arresting position. In a structurally simple solution, the at least one arresting element and the spring device can simultaneously also form parts of the locking device. In a first mounting step, the pre-stressed arresting element serves as the locking device which firstly has to be deliberately moved by a user into the release condition against the spring force. It is only in that release condition that an end of the synchronization rod can be connected to a corresponding part of the actuating device, in which case automatic clamping and/or latching of the synchronization rod can be effected by the spring-loaded arresting element.

The handle element to be actuated manually can be in the form of a slider by which the arresting element is movable at least into the release position. In the mounting procedure, therefore, the slider is urged against the force of the spring device loading the arresting element. After positioning of the synchronization rod relative to the corresponding part of the actuating device has been effected, the manual force is removed from the slider, followed then by automatic clamping or latching of the arresting element to the corresponding part of the actuating device.

Alternatively, the handle element can also have a pivotably mounted lever by which the arresting element can be clampingly fixed relative to at least one of the two actuating devices. In a preferred embodiment, the pivotably mounted lever can also be part of the locking device. In this connection, the fixing device has a cover means, wherein the cover means can be positioned over the other parts of the fixing device only when the synchronization rod is appropriately connected to at least one of the two actuating drives. The cover means thus forms a part of the fixing device, wherein the cover means can be mounted movably—in particular slidably—relative to the synchronization rod, preferably in such a way that it the cover means is captively secured to the synchronization rod.

The article of furniture according to the invention is characterized by at least one synchronization device of the described kind. In that case, the two actuating devices can be mounted to opposite side walls of a furniture carcass, in which case a movement of the two actuating devices can be synchronized by way of the synchronization rod.

The article of furniture according to the invention is characterized by at least one synchronization device of the kind described.

BRIEF DESCRIPTION OF THE DRAWINGS

Further details and advantages of the present invention are described with reference to the specific description hereinafter. In the drawings.

DETAILED DESCRIPTION OF THE PRESENT INVENTION

Figure 1A:
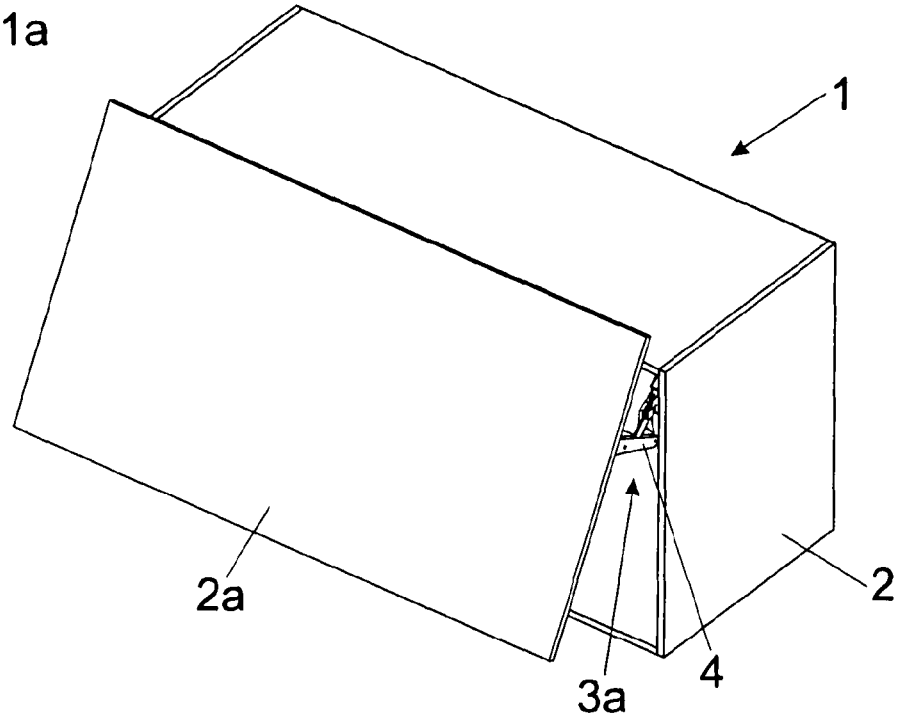
FIGS. 1*a*, 1*b* show a perspective view of an article of furniture with an upwardly movable flap and a partly broken-away view of the article of furniture with the flap removed.
Figure 1B:
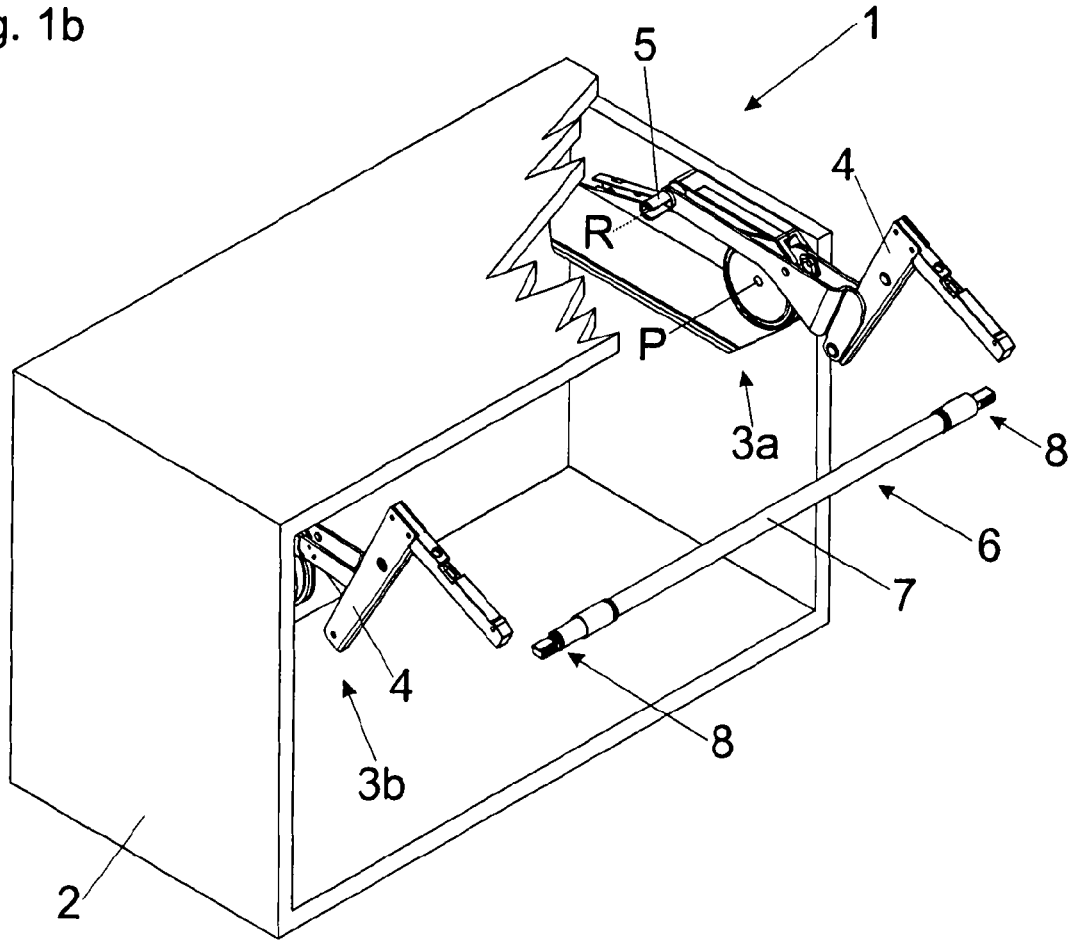

FIG. 1*a* shows a perspective view of an article of furniture 1 having a furniture carcass 2 and a flap 2*a* which is movable upwardly relative thereto. It is possible to see an actuating device 3*a* having at least one pivotably mounted actuating arm 4, the (first) actuating device 3*a* being provided to move the flap 2*a*. FIG. 1*b* shows a perspective and partly broken-away view of the article of furniture 1 with the flap 2*a* removed, also showing the oppositely disposed (second) actuating device 3*b*. The two actuating devices 3*a*, 3*b* can basically be identical and each have a drive device (not shown in greater detail here) in the form of a spring device and/or an electric motor, wherein the respective actuating arm 4 can be urged in the opening direction about the axis of rotation P by the drive device. The two actuating devices 3*a* and 3*b* each have a respective rotatable part 5 which is also rotated upon a movement of the flap 2*a* over a limited rotary angle range about the axis of rotation R. To synchronize a movement of the two actuating devices 3*a* and 3*b*, there is a synchronization device 6 having an elongated synchronization rod 7 which can be releasably connected by way of a fixing device 8 to the rotatable part 5 of the respective actuating device 3*a*, 3*b*. The device 6 can preferably be fitted without a tool and/or can preferably be dismantled without a tool. When the synchronization rod 7 is properly connected to the rotatable part 5 of the respective actuating device 3*a*, 3*b*, the desired synchronization of the two actuating devices 3*a* and 3*b* relative to each other can be brought about.

Figure 2A:
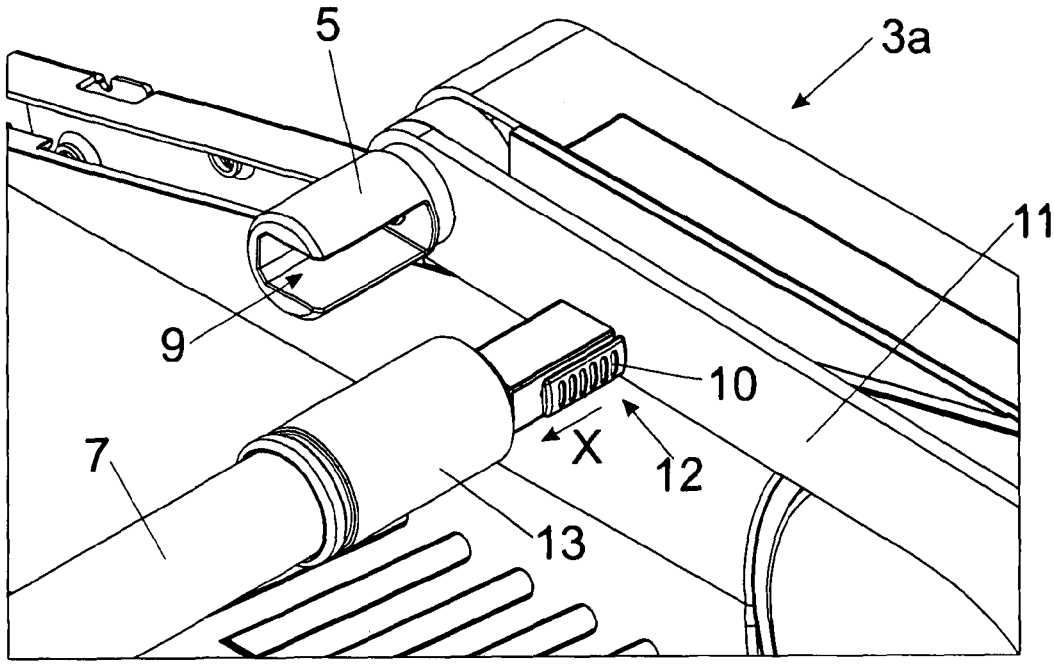
FIGS. 2*a*, 2*b* show the synchronization rod provided for synchronization of the two actuating devices with a locking device in the locking condition and a view of the synchronization rod mounted to the actuating drive.

FIG. 2*a* shows an enlarged view of the rotatable part 5 of the actuating device 3*a* shown in FIG. 1*b*. The rotatable part 5 is connected in a torque-proof manner to an intermediate lever 11 of the actuating device 3*a* so that, upon a movement of the furniture flap 2*a*, the intermediate lever 11 also rotates together with the rotatable part 5 over a limited rotary angle range about the axis of rotation R shown in FIG. 1*b*. The rotatable part 5 has a guide 9 for receiving and fixing the synchronization rod 7. The guide 9 is open forwardly so that the synchronization rod 7 can be connected to the rotatable part 5 even when the actuating device 3*a* with the rotatable part 5 was already pre-assembled to the furniture carcass 2.

Figure 2B:
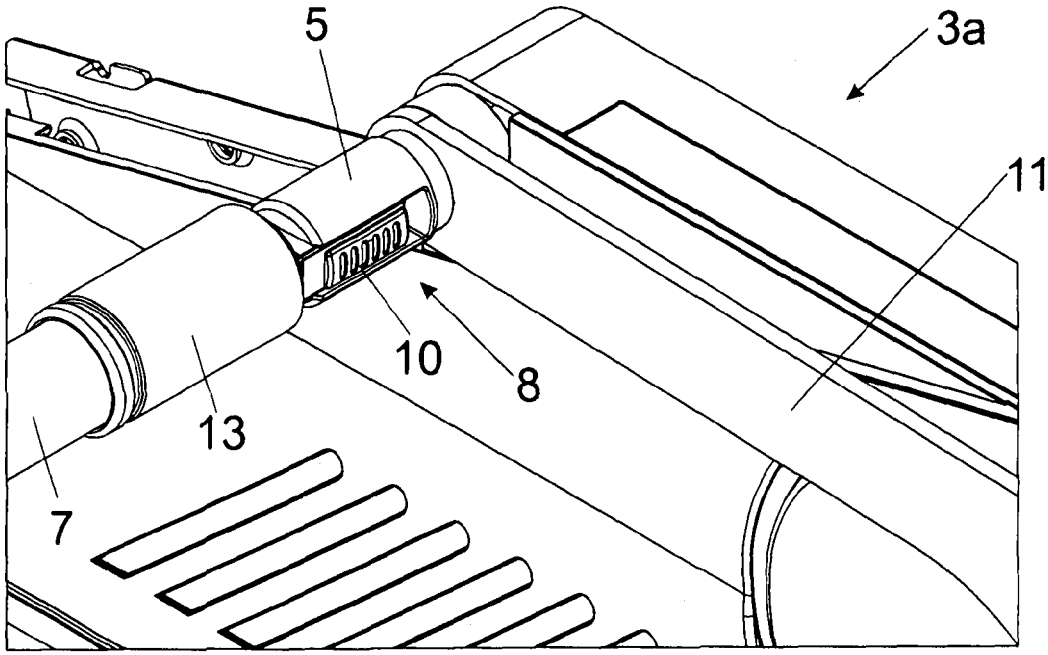

In the illustrated embodiment in FIG. 2*a*, the synchronization rod 7 has a locking device 12 which prevents the synchronization rod 7 from being connected in the locked condition of the locking device 12. In FIG. 2*a*, the locking device 12 is in the locking condition, that is to say the synchronization rod 7 cannot be connected to the rotatable part 5 of the actuating device 3*a* without prior actuation of the handle element 10 of locking device 12 because introduction of the synchronization rod 7 into the guide 9 of the rotatable part 5 is not possible when the locking device 12 is in the locking condition. It is only when the handle element 10 (which in the illustrated embodiment is in the form of a linearly slidable slider) is moved manually in the direction X in the mounting procedure that the locking device 12 is put into the release condition. Now with the handle element 10 pressed, the synchronization rod 7 can be introduced into the guide 9 of the rotatable part 5 whereupon automatic and correct locking to the rotatable part 5 of the actuating device 3*a* is effected by releasing the handle element 10. The mounted condition of the synchronization rod 7 is shown in FIG. 2*b*. The synchronization rod 7 is therefore now fixedly connected to the rotatable part 5 of the first actuating device 3*a*. That connection can be made by way of a force-locking and/or by way of an at least partly positively locking fixing device 8. A snap connection can be particularly desirably used in that respect. Mounted on the synchronization rod 7 is a preferably sleeve-shaped cover member 13 which, after the synchronization rod 7 has been mounted in position, can be pushed onto the rotatable part 5 whereby the remaining parts of the fixing device 8 can be substantially completely covered and it is possible for the synchronization rod 7 to fall out of the rotatable part 5.

Figure 3A:
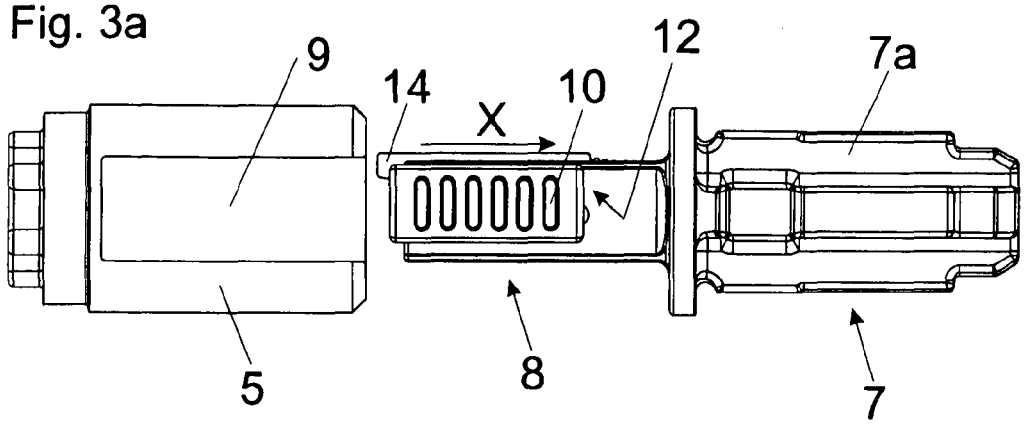
FIGS. 3*a*-3*c* show the locking device in the locking condition, a view in the mounted condition and a perspective view of the fixing device.
Figure 3B:
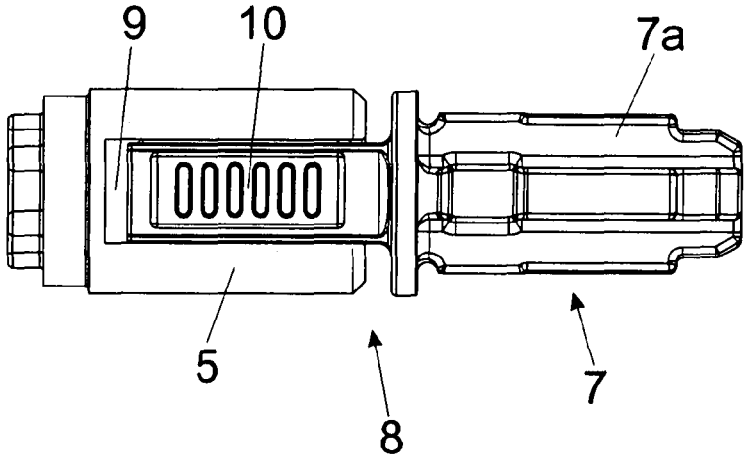
Figure 3C:
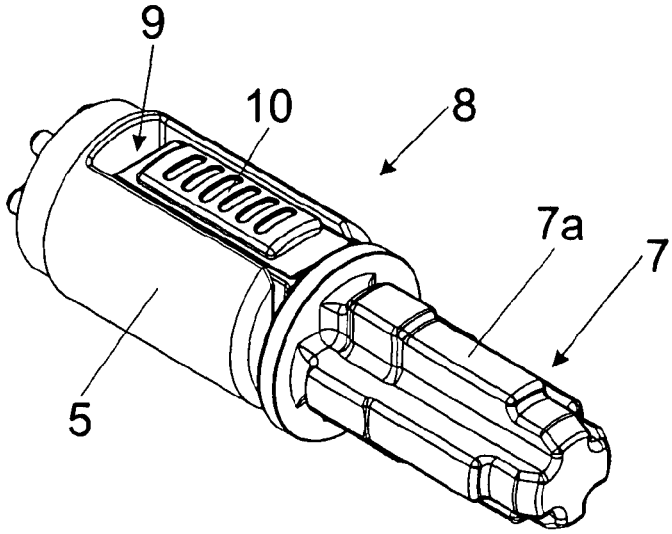

FIG. 3*a* shows a diagrammatic plan view of the rotatable part 5 with the guide 9 provided therein for receiving and fixing the synchronization rod 7. The synchronization rod 7 is of a multi-part structure and includes a plug-in portion 7*a* which can be releasably connected to the remaining part of the synchronization rod 7. It is possible to see the locking device 12 which is in the locked condition in the illustrated embodiment. That locked condition is made possible by an arresting element 14 on the synchronization rod 7 which in the position shown in FIG. 3*a* does not allow the synchronization rod 7 to be introduced into the guide 9 of the rotatable part 5. It is only when the handle element 10 of locking device 12 is urged in the direction X by a user that it is possible for the synchronization rod 7 to be introduced into the guide 9 of the rotatable part 5. After the synchronization rod 7 has been pushed into the guide 9, and by manual release of the handle element 10, the arresting element 14 is automatically clamped within the guide 9 by spreading of the arresting element 14, as shown in FIG. 3*b*. FIG. 3*c* shows a perspective view of the synchronization rod 7 with the plug-in portion 7*a* which can be connected—preferably in force-locking relationship—to the rotatable part 5.

Figure 4A:
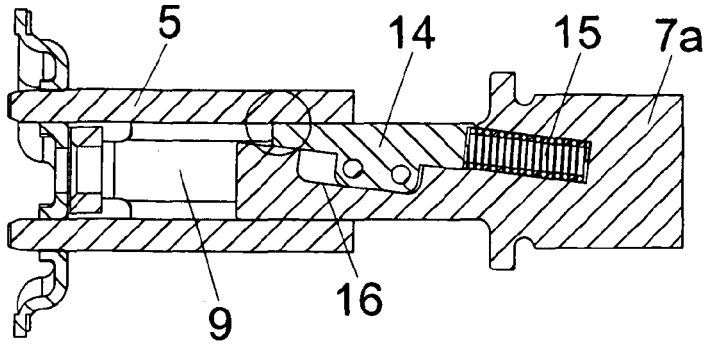
FIGS. 4*a*-4*c* show a view of the locking device in the release condition, in the mounted condition and an exploded view of the parts used.
Figure 4B:
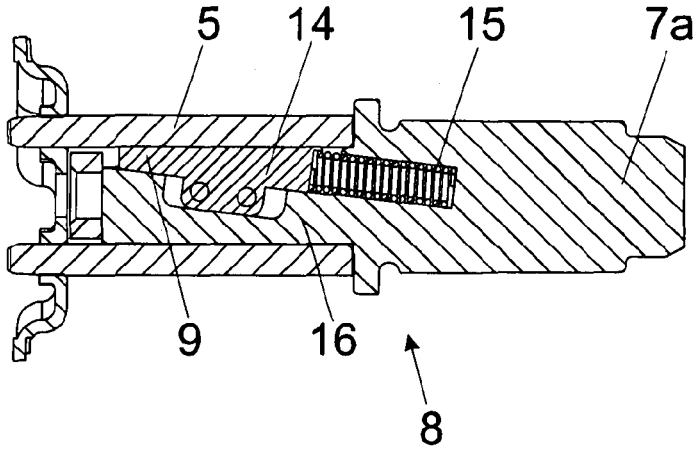
Figure 4C:
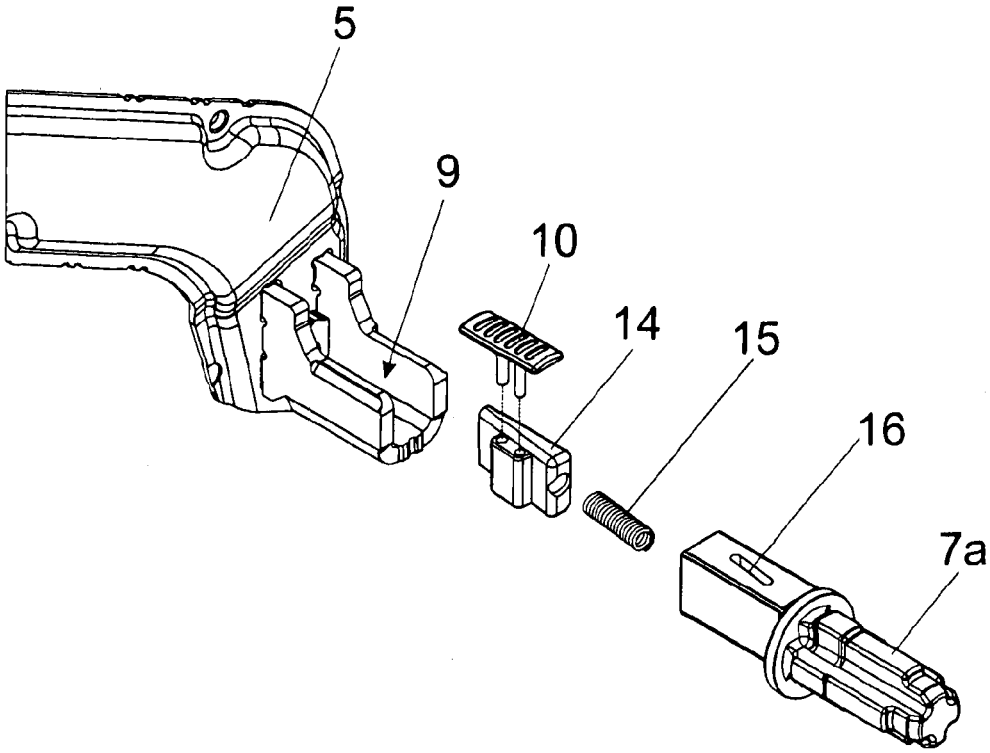

FIG. 4*a* shows a sectional view of the fixing device 8, wherein the plug-in portion 7*a* of the synchronization rod 7 has the arresting element 14 shown in FIG. 3*a*, which is constantly biased in the direction of the arresting position by a spring device 15. The arresting element 14 can be pushed against the force of the spring device 15 by the handle element 10 which is in the form of a slider, whereby the fixing device 8 can be put into the unlocked condition and the synchronization rod 7 can be introduced into the guide 9 of the rotatable part 5. The arresting element 14 is wedge-shaped and is mounted slidably along a corresponding inclined guide surface 16 of the plug-in portion 7*a*. The arresting element 14 is spread within the guide 9 of the rotatable part 5 by the inclined guide surface 16 and the force of the spring device 15, thereby producing a clamping connection to the rotatable part 5 as is shown in FIG. 4*b*. Thus, as shown in FIG. 4*b*, the arresting element 4 bears against the inner surface of the pivotable part 5. FIG. 4*c* shows an exploded view of the parts used. The rotatable part 5 has a guide 9, wherein the arresting element 14 which is biased by the spring device 15 produces a clamping connection between the plug-in portion 7*a* of the synchronization rod 7 and the rotatable part 5 of the respective actuating device 3*a*, 3*b*. The arresting element 14 can be moved into an unlocked position again by actuation of the handle element 10 against the spring force so that dismantling is also possible without any problem.

Figure 5A:
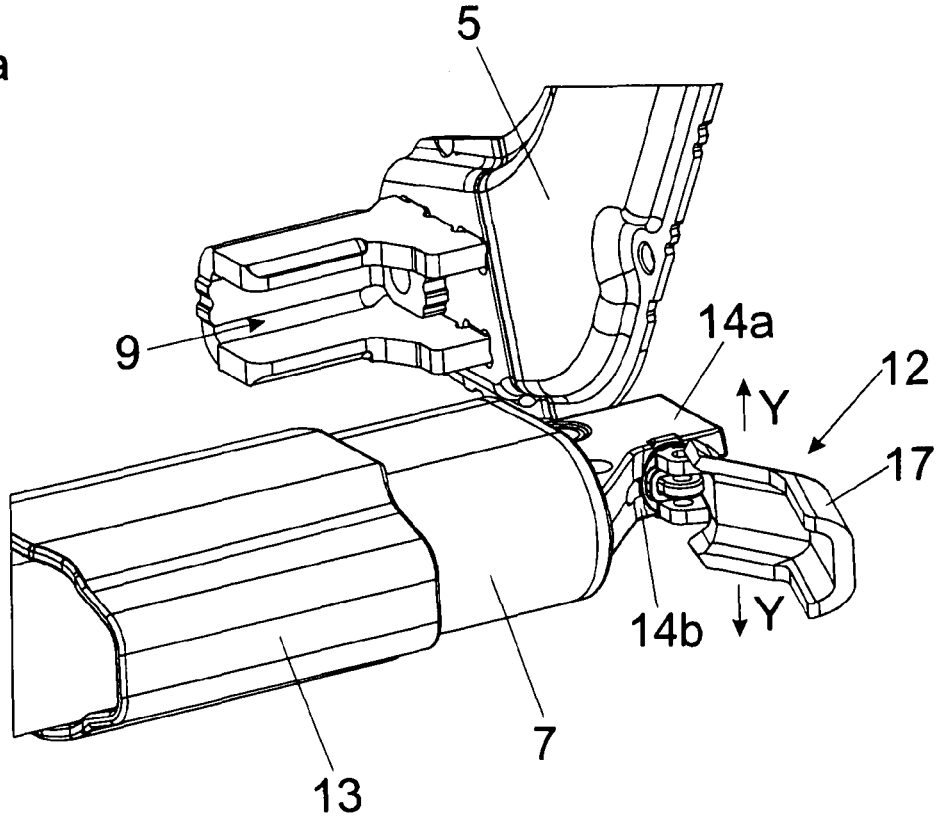
FIGS. 5*a*-5*d* show time sequences in mounting the synchronization rod to the rotatable part of the actuating drive, wherein the locking device is shown in a further embodiment.
Figure 5B:
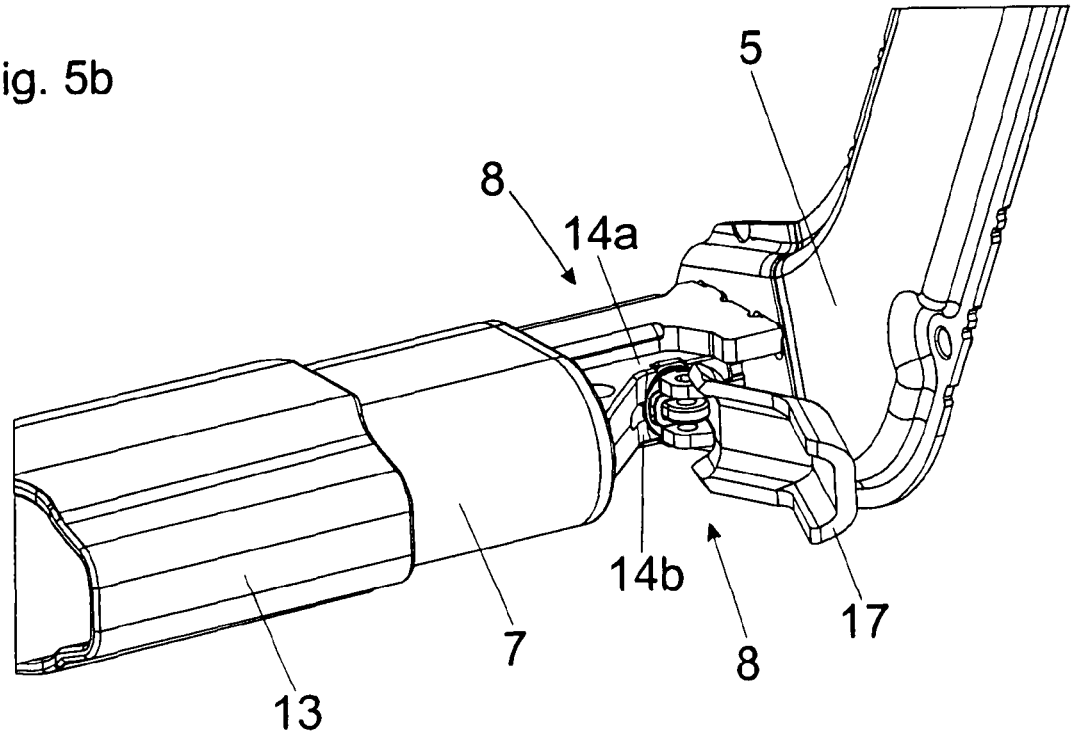
Figure 5C:
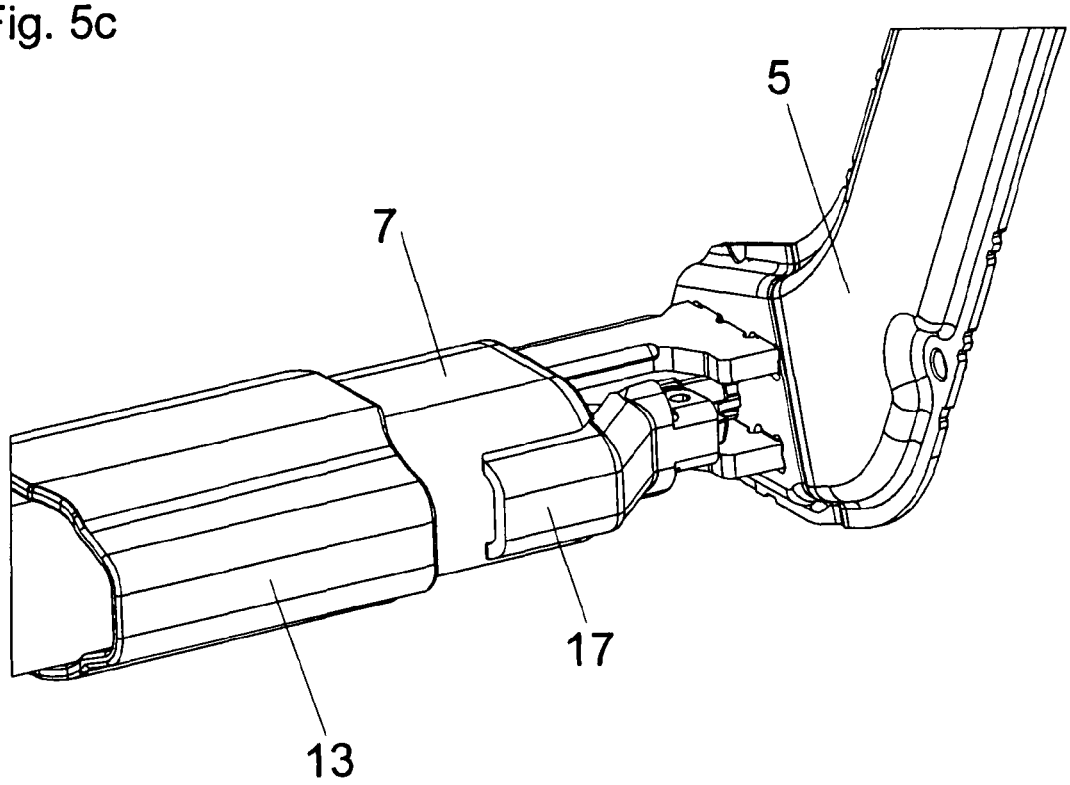
Figure 5D:
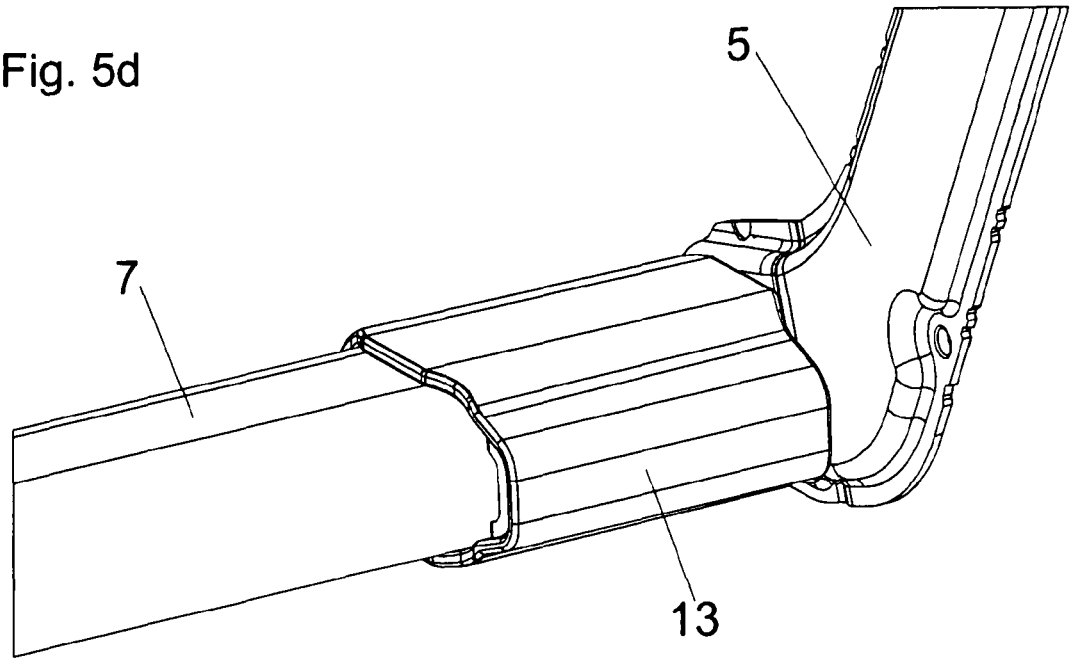

FIGS. 5*a* through 5*d* show a further embodiment of a locking device 12 which in the locking condition prevents proper fitment of the synchronization rod 7 to the rotatable part 5 of the actuating device 3*a* and 3*b*. In the illustrated Figure, the locking device 12 has a pivotably mounted lever 17 which at the same time also forms part of the fixing device 8 for fixing the synchronization rod 7 to the rotatable part 5. It is possible to see two arresting elements 14*a* and 14*b* which can each be spread in the direction Y by a pivotal movement of the lever 17, thereby forming a clamping connection between the synchronization rod 7 and the rotatable part 5. Reference number 13 denotes a cover member mounted slidably relative to the synchronization rod 7. In a first mounting step, therefore, the two arresting elements 14*a*, 14*b* which are in the release position are introduced into the guide 9 of the rotatable part 5, as shown in FIG. 5*b*. As long as the lever 17 has not been actuated, the cover member 13 cannot be properly positioned over the remaining part of the fixing device 8 by the projecting lever 17. The two arresting elements 14*a* and 14*b* are spread within the guide 9 of the rotatable part 5 by tilting of the lever 17, whereupon the lever 17 assumes a position as shown in FIG. 5*c*. The lever 17 in FIG. 5*c* now bears against an outside surface of the synchronization rod 7. It is only in that pivotal position of the lever 17 that the cover member 13 can be properly positioned over the remaining part of the fixing device 8, as shown in FIG. 5*d*.

Even if the invention has been described in detail by reference to the illustrated embodiments, the invention is not limited to those embodiments. Rather, a basic idea of the invention is to provide a locking device which prevents connection of the synchronization rod 7 in the locking condition so that incorrect assembly is excluded from the outset. It is only after the locking device has been intentionally moved into a release condition that correct assembly can be performed or properly concluded.

It will be appreciated that it is also possible for the synchronization rod 7 to be variable in length—in particular adjustable in length. It should also be noted that the proposed synchronization device 6 can also be used for stabilizing the running characteristics of a drawer which is displaceable in a furniture carcass 2, in which case the drawer has at opposite sides at least one respective gear performing the function of the rotatable part 5, which mesh with a corresponding rack. The desired synchronous movement of the two gears can be implemented in the mounted condition by way of the proposed synchronization device 6.

The invention claimed is:

1. A synchronization device for allowing synchronous movement of a first actuating device with a second actuating device, the first actuating device and the second actuating device to be mounted on an article of furniture for moving a movable furniture part, said synchronization device comprising:

a rotatable part to be fixed to at least one of the first actuating device and the second actuating device, said rotatable part having an inner surface forming a guide; and a synchronization rod for transmitting a synchronous movement of the first actuating device and the second actuating device, said synchronization rod including:

a locking device for releasably mounting said synchronization rod to said rotatable part, said locking device including a handle element to be actuated by a user;

a releasable fixing device movable between a locked position and an unlocked position by said handle element, said fixing device including a spring and a spring-loaded arresting element constantly biased by said spring toward an arresting position; and a plug-in portion having an inclined guide surface inclined along a longitudinal axis of said synchronization rod, said fixing device being mounted to said plug-in portion so that said arresting element slides along said inclined guide surface of said plug-in portion as said fixing device is moved between the locked position and the unlocked position;

wherein said rotatable part, said handle element, said spring, and said arresting element are configured such that:

when said handle element is not actuated by the user and said synchronization rod is not mounted to said rotatable part, said spring urges said arresting element toward the arresting position so that said fixing device is in the locked position by default, and said fixing device prevents said synchronization rod from being mounted to said rotatable part;

when said handle element is moved to an unlocking position by the user, said handle element moves said arresting element against a biasing force of said spring so as to place said fixing device in the unlocked position and allow said synchronization rod to be mounted to said rotatable part;

when said handle element is released by the user with said synchronization rod mounted to said rotatable part, said spring urges said arresting element toward the arresting position so that said arresting element bears against said inner surface of said rotatable part to secure said synchronization rod to said rotatable part.

2. The synchronization device according to claim 1, wherein said arresting element is substantially wedge-shaped and is mounted movably relative to an elongated body of said synchronization rod.

3. The synchronization device according to claim 1, wherein said arresting element is mounted slidably in a longitudinal direction of said synchronization rod.

4. The synchronization device according to claim 1, wherein said handle element is formed as a slider for moving said arresting element into the unlocked position.

5. The synchronization device according to claim 1, wherein said handle element is formed as a pivotably mounted lever for clamping said arresting element to said rotatable part.

6. The synchronization device according to claim 1, wherein said arresting element is one of at least two arresting elements movable into a clamping position by said handle element to fix said synchronization rod to said rotatable part.

7. The synchronization device according to claim 1, wherein said fixing device is configured to mount said synchronization rod to said rotatable part pre-assembled to a side wall of a furniture carcass.

8. The synchronization device according to claim 1, wherein said guide of said rotatable part is U-shaped, and said synchronization rod is secured within said U-shaped guide by said arresting element.

9. The synchronization device according to claim 1, wherein said fixing device further includes a cover member.

10. The synchronization device according to claim 1, wherein said cover member is mounted displaceably relative to said synchronization rod.

11. The synchronization device according to claim 1, wherein said inclined guide surface of said plug-in portion is inclined outwardly toward said rotatable part so as to push said arresting element outwardly against said inner surface of said rotatable part as said spring urges said arresting element into said arresting position.

12. An article of furniture comprising said synchronization device according to claim 1.

13. The article of furniture according to claim 12, further comprising:

a furniture carcass; and two actuating devices mounted to opposite side walls of said furniture carcass;

said synchronization rod of said synchronization device is configured to synchronize a movement of said two actuating devices.

* * * * *